United States Patent [19]

Lambert et al.

[11] Patent Number: 4,630,786

[45] Date of Patent: Dec. 23, 1986

[54] APPARATUS FOR DISPENSING PLASTICS STRETCH FILM

[75] Inventors: James Lambert, Kehlen, Luxembourg; William E. Rice, Fairport, N.Y.

[73] Assignee: Mobil Oil Corporation, New York, N.Y.

[21] Appl. No.: 858,876

[22] Filed: May 1, 1986

Related U.S. Application Data

[63] Continuation of Ser. No. 636,771, Aug. 1, 1984, abandoned.

[30] Foreign Application Priority Data

Feb. 8, 1984 [GB] United Kingdom ..... 8403314

[51] Int. Cl.[4] ..... B65H 23/06; B65H 75/40

[52] U.S. Cl. ..... 242/96; 242/75.4; 242/99

[58] Field of Search ..... 242/96, 99, 156, 156.2, 242/75.4, 55.2, 55.54, 68, 68.3, 68.4; 53/390; 156/574, 577, 579

[56] References Cited

U.S. PATENT DOCUMENTS

| | | | |
|---|---|---|---|
| 3,944,148 | 3/1976 | Freeman et al. | 242/75.4 X |
| 3,950,214 | 4/1976 | Pool et al. | 156/577 X |
| 4,102,513 | 7/1978 | Guard | 242/75.4 |
| 4,166,589 | 9/1979 | Hoover et al. | 242/75.4 |
| 4,179,081 | 12/1979 | Parry | 242/99 |
| 4,248,392 | 2/1981 | Parry | 242/96 |
| 4,369,614 | 1/1983 | Tetzner | 53/390 X |
| 4,477,037 | 10/1984 | Goldstein | 242/96 X |
| 4,484,717 | 11/1984 | Goldstein | 242/96 |
| 4,530,473 | 7/1985 | Parry | 242/96 X |
| 4,535,951 | 8/1985 | Riemenschneider, III | 242/96 X |

FOREIGN PATENT DOCUMENTS

| | | | |
|---|---|---|---|
| 2065070 | 6/1981 | United Kingdom . | |
| 1604345 | 12/1981 | United Kingdom . | |
| 2109772 | 6/1983 | United Kingdom | 242/96 |
| 2,115,783 | 9/1983 | United Kingdom . | |
| 2,121,001 | 12/1983 | United Kingdom . | |

*Primary Examiner*—Stanley N. Gilreath

*Attorney, Agent, or Firm*—A. J. McKillop; M. G. Gilman; J. P. O'Sullivan, Sr.

[57] ABSTRACT

An apparatus for stretching a plastic film around a package is disclosed wherein two handles are secured to the core of the plastic film, one handle effectively extending the core and having a braking cover for dispensing speed control. The other handle includes a U-shaped member to provide a second grip parallel to, but displaced from the axial centerline of the core. The plastic film is configured between the two handles for rotation about the centerline axis of its core.

2 Claims, 1 Drawing Figure

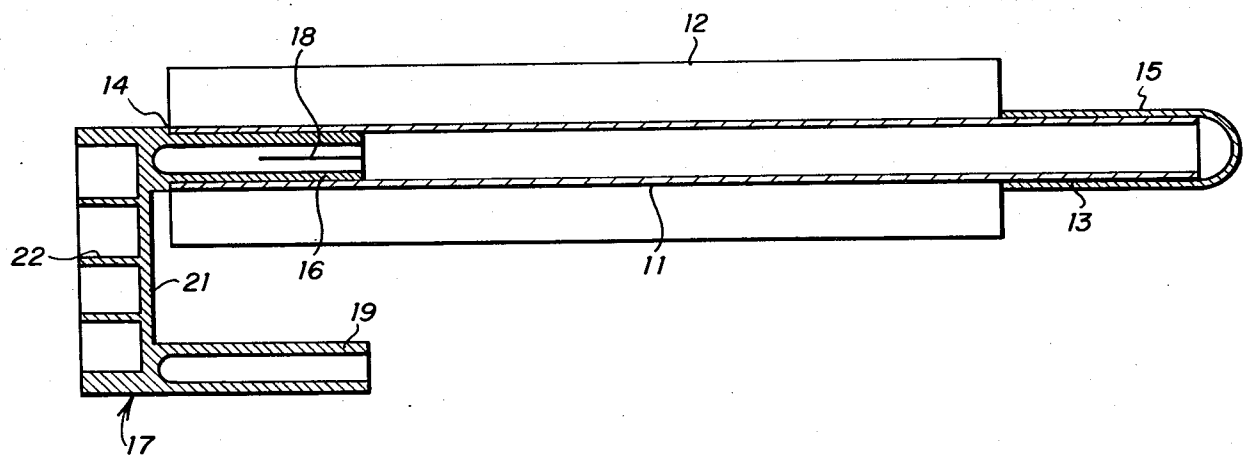
15
13
12
11
18
16
19
14
21
17
22

APPARATUS FOR DISPENSING PLASTICS STRETCH FILM

This is a continuation of copending application Ser. No. 636,771, filed on Aug. 1, 1984, now abandoned.

BACKGROUND OF THE INVENTION

This invention relates to apparatus for dispensing plastics stretch film and in particular for manually wrapping plastics stretch film around a package, for example a loaded pallet.

There exist many apparatus for wrapping a plastic film around a package. One such apparatus is disclosed in U.S. Pat. No. 4,179,081. The apparatus of the patent is for manually dispensing plastics stretch film in which the film is contained on a core having extended ends. A pair of flexible hand grips are rotatably mounted on the ends of the core whereby control of the tension on the film during dispensing can be achieved by manually squeezing the hand grips to effect a braking action on the core. While this apparatus provides a satisfactory manual dispenser for stretch film, it suffers from the disadvantage that it is difficult, in view of the projecting ends of the core, to wrap film around a package near the ground-engaging surface of the package. An object of the present invention is therefore to obviate or minimize this problem.

SUMMARY OF THE INVENTION

Accordingly, the invention resides in apparatus for manually dispensing plastics stretch film comprising a hollow core for receiving a roll of the film, the core being of a length such that it projects from one end, but not both ends, of the film in use. A flexible hand grip is rotatably mounted on said one end of the core to permit control of the tension on the film during manual dispensing of the film. A generally U-shaped handle is separate from the core and having one limb rotatably mounted in the other end of the core, the other limb of the handle being generally parallel with, but spaced from, the axis of the core and extending towards the opposite end of the core. Control of the tension on the film during wrapping can be achieved by squeezing the single hand grip, whereas the provision of the U-shaped handle at the other non-extending end of the core ensures that plastic film can be wrapped adjacent the ground engaging surface of a package.

BRIEF DESCRIPTION OF THE DRAWING

The accompanying drawing is a sectional view of a plastic film dispenser.

DESCRIPTION OF THE PREFERRED EMBODIMENT

Referring to the drawing, the apparatus includes a hollow core 11 around which is wound a roll of plastics stretch film 12. The length of the core 11 exceeds the width of the film 12 so that one end 13 of the core 11 extends from the adjacent edge of the roll of stretch film. End 13 of the core 11 comprises a first handle which extends along the axial centerline of the core and is fixed to the core for simultaneous rotation therewith. The other end 14 of the core is, however, arranged so as to lie flush with the adjacent edge of the film.

Rotatably mounted on the extending end 13 of the core 11 is a flexible hand grip 15 conveniently in the form of a cup-shaped PVC member. If desired, the external surface of the hand grip 15 may be provided with axially extending ribs [not shown] to facilitate gripping thereof.

Mounted in the other end 14 of the core 11 is one limb 16 of a generally U-shaped handle 17, conveniently molded in polyethylene or other suitable thermoplastics material. The limb 16 of the handle 17 is generally in the form of a hollow cylinder which, at least at its free end, is normally of increased external diameter as compared to the internal diameter of the core. The limb 16 is, however, formed with an axially extending slot 18 so that, by resiliently deforming the limb 16 so as to close the slot 18, the limb 16 can be inserted into the end 14 of the core 11. In use, therefore, the limb 16 is urged by its own resilience against the internal surface of the core 11 so that the handle 17 is releasably retained by the core but at the same time the core is free to rotate relative to the handle.

The other limb 19 of the handle 17 is also in the form of a hollow cylinder whose axis is parallel with, but spaced from, the axis of the core 11 and which extends towards the end 13 of the core. The limb 19 is conveniently formed with external, axially extending ribs to facilitate gripping of the handle 17 and is joined to the limb 16 by a base member 21 in the form of a shallow trough strengthened by internal ribs 22. It is to be appreciated that by arranging that the limbs 16, 19 are hollow and the base member 21 is in the form of a trough minimizes the amount of material required to mold the handle 17. In this way the cost of the handle 17 is minimized so that the entire assembly of the handle 17, core 11 and hand grip 15 can be thrown away after the roll of film 12 has been used up.

When the apparatus described above is used to wrap the film 12 around a package, such as a loaded pallet, the operator grips the limb 19 of the handle 17 and the hand grip 15. Then, by squeezing the hand grip 15, the operator can adjust the tension on the film 12 to stretch the film during wrapping. In addition, since the film 12 extends up to the other end 14 of the core 11 and the handle 17 projects therefrom only by the height of the shallow base member 21, the film 12 can be readily wrapped adjacent the ground-engaging surface of the package.

What is claimed is:

1. An apparatus for dispensing plastic film having a hollow core with an axial centerline comprising:

a first handle extending along the axial centerline of the core and fixed to the core for simultaneous rotation therewith;

a flexible handgrip covering said first handle configured for slideable rotation on said first handle; and a second generally U-shaped handle with two members, a first resilient member having a centerline coincident with said centerline of said core and a second member having a centerline parallel to said centerline of said core, said first member mounted in said core to remain stationary and urging by its own resiliency against the internal surface of said core, while permitting axial rotation of said core and said second member arranged to provide a handgrip.

2. A plastic film dispenser comprising two handles for use with a plastic film roll having a hollow core with an axial centerline, a first handle fixed to said core for rotation therewith and having a slideably mounted handrip, a second handle mounted in said core for permitting rotation of said core while said second handle remains stationary, said second handle being U-shaped with three members, one resilient member mounted in said core and urging by its own resiliency against the internal surface of said core, a second member parallel to said core and a third member connecting said one member and said second member, said third member mounted perpendicular to said core and extending slightly beyond said core.

* * * * *